US011364401B2

(12) United States Patent
Shi et al.

(10) Patent No.: US 11,364,401 B2
(45) Date of Patent: Jun. 21, 2022

(54) AUTOMATIC CONTROL TYPE HOT SMOKE TESTING SYSTEM

(71) Applicant: China Academy of Safety Science and Technology, Beijing (CN)

(72) Inventors: Congling Shi, Beijing (CN); Honglei Che, Beijing (CN); Jian Li, Beijing (CN); Xingkai Zhang, Beijing (CN); Fei Ren, Beijing (CN); Xiaodong Qian, Beijing (CN); Jiehong Shi, Beijing (CN); Li He, Beijing (CN); Chen Zhao, Beijing (CN); Xuan Xu, Beijing (CN); Binbin Wu, Beijing (CN)

(73) Assignee: China Academy of Safety Science and Technology, Beijing (CN)

( * ) Notice: Subject to any disclaimer, the term of this patent is extended or adjusted under 35 U.S.C. 154(b) by 0 days.

(21) Appl. No.: 17/396,922

(22) Filed: Aug. 9, 2021

(65) Prior Publication Data

US 2022/0040517 A1 Feb. 10, 2022

(30) Foreign Application Priority Data

Aug. 10, 2020 (CN) ..... 202010795311.7

(51) Int. Cl.

*A62C 37/00* (2006.01)
*A62C 37/50* (2006.01)
*G08B 17/10* (2006.01)

(52) U.S. Cl.

CPC ..... *A62C 37/50* (2013.01); *G08B 17/10* (2013.01)

(58) Field of Classification Search

CPC ..... A62C 37/50; G08B 17/10; G08B 29/043; G01M 99/002; G01M 99/008; G05D 27/02

See application file for complete search history.

(56) References Cited

U.S. PATENT DOCUMENTS 4,931,011 A * 6/1990 Reiser ..... F23N 5/24 431/29
4,934,272 A * 6/1990 Sternin ..... A23B 4/044 44/590

(Continued)

FOREIGN PATENT DOCUMENTS

CN 102162375 B 5/2013

*Primary Examiner* — Ojiako K Nwugo
(74) *Attorney, Agent, or Firm* — Rankin Hill & Clark LLP; Christopher Jan Korff

(57) ABSTRACT

The present disclosure relates to an automatic control type hot smoke testing system which includes a fire source system, a smoke generation system and a control system. The fire source system is used for generating fire source and includes a first tank and several liquid fuel atomizing jet burners, wherein the first tank includes an air tank which is used for providing air and a fuel control tank which is used for controlling valves, distributing fuel and inspecting flame of the burners. The smoke generation system is used for generating smoke and includes a second tank, a smoke outlet pipe, smoke cake clamps and smoke cake turntables. Smoke cakes are initially placed in the smoke cake clamps, then moved to an ignition position one by one by for ignition, and finally rotated to through hole positions of a smoke generation box to fall into the smoke generation box by the servo motor. The control system is used for controlling the fire source system and the smoking generation system. The present disclosure overcomes the defects of the traditional manual hot smoke test, and realizes the accurate control of the smoke generation speed, the fire source power and the burning time, which has the characteristics of accuracy, light weight, automation and convenient disassembly and transportation.

24 Claims, 5 Drawing Sheets

(56) References Cited

U.S. PATENT DOCUMENTS

| | | | | |
|---|---|---|---|---|
| 5,013,567 | A * | 5/1991 | Govenius | A23B 4/0523 426/314 |
| 5,421,214 | A * | 6/1995 | Burgdorfer | G01N 1/2202 73/863.22 |
| 5,647,054 | A * | 7/1997 | Jones | G01M 9/04 392/397 |
| 6,436,210 | B1 * | 8/2002 | Groc | C06D 3/00 149/19.91 |
| 6,601,776 | B1 * | 8/2003 | Oljaca | B05B 17/04 977/869 |
| 2007/0039744 | A1 * | 2/2007 | Pavesi | A62C 3/0257 169/49 |
| 2010/0140417 | A1 * | 6/2010 | Bose | B64C 3/14 244/35 R |
| 2015/0113855 | A1 * | 4/2015 | Asciutto | A01M 17/00 43/127 |
| 2020/0351192 | A1 * | 11/2020 | Murao | G06Q 50/30 |

* cited by examiner

AUTOMATIC CONTROL TYPE HOT SMOKE TESTING SYSTEM

CROSS-REFERENCE TO RELATED APPLICATIONS

This application claims priority to Chinese Patent Application No. 202010795311.7, filed on Aug. 10, 2020, which is hereby incorporated by reference in their entirety.

TECHNICAL FIELD

The present disclosure relates to an automatic control type hot smoke testing system, which is mainly applied to on-site hot smoke testing for performance of disaster prevention and safety of urban rail transit. The present disclosure belongs to the technical field of urban rail transit safety detection.

BACKGROUND ART

Subway is a space network operating with large-scale passenger flow and complex giant system with highly gathered equipment and facilities. In trial operation stage or formal operation stage, once a fire accident occurs, the loss will be great. The rapid detection and alarm, effective ventilation and smoke discharge and safe personnel evacuation in the case of fire accidents are important parts of securing subway safety. The key problems that need to be solved at present are how to detect the safe operation conditions of subway disaster prevention systems such as the fire detection and alarm system, the station ventilation and smoke discharge system, the integrated supervisory control system, station and tunnel heat exhaust fans, tunnel smoke exhaust fans, air valves, emergency lighting, gates, non-firefighting power cutoff, alarm bells, emergency broadcasting, escalators and elevators etc., and judge whether each disaster prevention system can act correctly and achieve disaster prevention safety performance under the accident conditions. In the existing on-site detection methods of the subway disaster prevention system, the cold smoke test method is frequently used, in which smoke is generated by burning smoke generation materials (smoke cakes or smoke guns) that do not have real fire power (heat release rate), so that the smoke is not driven by buoyancy, which is unable to reflect the diffusion and control effects of the fire smoke truly and the integral working effect of the disaster prevention system caused by relatively simple detectable index. In the aspect of laboratory test research aiming at a subway disaster prevention system, scholars mostly adopt a scale-reducing simulation technology to establish a scale-reducing subway fire experiment model. However, the cold smoke testing technique and the scale-reducing simulation technique have the following disadvantages: the comprehensive test of full size cannot be carried out, the number of test indicators is less, and the conformity with the actual fire disaster needs to be improved. The Chinese patent CN102162375B discloses an on-site hot smoke testing device and method for subway stations and tunnels, the main smoke generation device and the fire source simulation device are non-automatic control types. The smoke generation device is smoke cakes, which are placed and ignited manually to generate smoke naturally. The smoke generation cannot be stopped when the smoke is naturally generated, the smoke generation speed is uncontrollable, and the smoke cakes need to be manually replaced after being burnt. Moreover, the fire source is 'pool fire' composed of a metal pan container and fuel, the combustion heat release rate of which is fixed and determined by the area of the container. The defects of the fire source are not dynamically adjustable, uncontrollable combustion time and so on. With the advancement of technology and the need for on-site hot smoke testing, there is a need for an automatic control type hot smoke testing system with automatic, accurate and modular process control and higher safety fuel injection system protection.

SUMMARY OF THE INVENTION

In order to solve the above-mentioned problems, the present disclosure aims to provide an automatic control type hot smoke testing system, which is light, automatic and convenient to disassemble and transport.

The object of the present disclosure is realized by the following technical scheme:

an automatic control type hot smoke testing system is characterized by including a fire source system, a smoke generation system and a control system;

the fire source system includes a first tank and several liquid fuel atomizing jet burners disposed above the first tank, wherein the first tank includes an air tank and a fuel control tank, and the bottom main body of each of the liquid fuel atomizing jet burners extends into the first tank and provides an air duct and a fuel duct, and the air duct extends into the air tank and is equipped with an air inlet; the fuel control tank includes several fuel control valves and a fuel distribution box, and a fuel supply pipe disposed outside the first tank is connected with the fuel duct through the fuel distribution box and the several fuel control valves in sequence;

the smoke generation system includes a second tank, a smoke outlet pipe, smoke cake clamps and smoke cake turntables;

the second tank includes a smoke generation electrical control box and a smoke generation box, which are positioned at two sides of the second tank respectively;

the smoke outlet pipe arranged at the top of the smoke generation box is communicated with the smoke generation box;

the smoke cake clamps vertically arranged at the outer side of the top of the second tank, are used for storing smoke cakes;

the smoke cake turntables are horizontally arranged at the top of the second tank and are positioned between the smoke cake clamps and the second tank; the smoke cake turntables are driven by a servo motor to rotate, moving smoke cakes in the smoke cake clamps to an ignition position one by one to be ignited, and then rotating the ignited smoke cakes into the smoke generation box;

wherein, a smoke outlet of the smoke outlet pipe is positioned right above the liquid fuel atomizing jet burners of the fire source system;

the control system is connected with the smoke generation electrical control box and the fuel control tank respectively, in which an embedded computing platform is arranged. And an external touch screen is set for Human Computer Interaction to control the hot smoke testing system.

Furthermore, a bottom main body of each of the liquid fuel atomizing jet burners is a coaxial hollow cylinder, an outer ring of which is the air duct, and the fuel duct is disposed in the air duct.

Furthermore, the air duct is formed by connecting an upper air duct and a lower air duct by a first flange, and fixed on the top of the air tank by the first flange; the fuel duct is fixed at the bottom of the fuel control tank by a second flange disposed at the bottom of the fuel duct.

Furthermore, an air inlet of the air tank is connected with a combustion fan through an air conduit provided at one side of the first tank.

Furthermore, the top of the fuel duct is equipped with a rectifier wheel, and the top of the air duct is equipped with a cowling, wherein the rectifier wheel is located inside the cowling.

Furthermore, the top of the fuel duct is further provided with a fuel atomizing nozzle and an ignition needle.

Furthermore, a first electrical control box and several electronic high-voltage ignition transformers are further arranged in the fuel control tank, wherein the electronic high-voltage ignition transformers are connected with the ignition needles and the first electrical control box is used for controlling the fuel control valves and the electronic high-voltage ignition transformers.

Furthermore, thermocouples are arranged in the fuel control tank and connected to the first electrical control box.

Furthermore, a guardrail is arranged around the several liquid fuel atomizing jet burners at the top of the first tank.

Furthermore, the air tank and the fuel control tank are both made of 304 stainless steels, and the fuel control tank is located at the bottom of the air tank.

Furthermore, the fuel control valves are electromagnetic valves.

Furthermore, each of the smoke cake turntables includes a top cover, a bottom cover and a rotary disc arranged between the top cover and the bottom cover. And an output shaft of the servo motor sequentially passes through the bottom cover, the rotary disc and the top cover and drives the rotary disc to rotate. Each of the smoke cake clamps is fixed in a smoke cake clamp jack on the top cover, and a first through hole and a second through hole which are matched with the size of a smoke cake are respectively arranged on the rotary disk and the bottom cover, wherein the first through hole and the second through hole are in a staggered arrangement, with the second through hole located right above the smoke generation box.

Furthermore, the smoke outlet pipe is a telescopic pipe with adjustable length, and fixed by a smoke outlet pipe bracket vertically standing on the ground.

Furthermore, the middle part of the smoke outlet pipe is provided with a pipe hoop which is connected with the top of the smoke outlet pipe bracket though a bolt, and the height of the smoke outlet pipe bracket in the vertical direction is adjustable.

Furthermore, the inner bottom side of the smoke generation box is a smoke cake drawer, in which a grid plate is arranged, and the smoke cakes fall onto the grid plate.

Furthermore, a speed-regulating blower is arranged at the bottom of the smoke generation electrical control box, and ventilation holes are provided on a wall connecting the smoke generation electrical control box and the smoke generation box, the positions of ventilation holes correspond to the position of the speed-regulating blower and the grid plate.

Furthermore, the bottom cover is provided with igniters which are arranged between a smoke cake entrance (217) and the second through hole (221) on the bottom cover (220).

Furthermore, the igniters use silicon carbide as the heat generation source.

Furthermore, position sensors are arranged on the inner side of the bottom cover.

Furthermore, the number of the smoke cake turntable(s) is one, two or more, corresponding to the number of the smoke cake clamp(s).

Furthermore, the bottoms of the first tank and the second tank are both equipped with rollers.

Furthermore, an integrated control box is provided in the control system, and connected to the smoke generation electrical control box and the fuel control tank respectively.

Furthermore, a fuel pump, a fuel filter, a pressure stabilizing tank and a rotameter are arranged in the control system in sequence; the integrated control box controls the fuel flow by controlling the rotating speed and the pressure of the fuel pump; the measurement of the fuel flow is transmitted back to the integrated control box by the rotameter.

Furthermore, the touch screen includes a touch screen coming with a host panel of the control system and a remote touch screen connected with the control system, which both have emergency stop buttons.

The beneficial effects of the present disclosure are as follows:

The present disclosure overcomes the problems of manual replacement of the smoke cakes and the oil pan, uncontrollable smoke generation speed burning time and non-tunable fire source power in the traditional hot smoke testing system.

The smoke generation system of the automatic control type hot smoke testing system uses the servo motor and the planetary reducer to provide power to rotate the rotary discs and carry the smoke cakes: the smoke cakes are initially placed in one smoke cake clamp, then the rotary disks move the smoke cakes to an ignition position one by one for ignition, and rotate to the hole positions of the smoke generation box to make the smoke cakes fall into the smoke generation box. By setting up the smoke cake clamp or a plurality of smoke cake clamps, it is more convenient to add the smoke cakes, install the smoke cakes faster, and store a plurality of smoke cakes at the same time, which may prolong smoking time and improve smoking speed. In addition, the automatic rotation, ignition and falling of the smoke cakes can be realized by arranging the smoke cake turntables, the igniters and the position sensors; the adjustable smoke cakes placing speed is realized by adjusting the rotating speed of the rotary disc(s) and controlling the residence time of the rotary disc(s); the smoke outlet speed can be controlled by adjusting the speed of the blower. The smoke generation box and the smoke generation electrical control box are relatively sealed, so that smoke generated is intensively emitted from the smoke outlet pipe; and the smoke generation box and the smoke generation electrical control box are physically isolated by a partition plate, so that can avoid the corrosion of strong corrosive gas generated in the smoke generation process of the smoke cakes to the electric equipment and prolong the service life of the instrument and equipment.

The igniters in the smoke generation system use silicon carbide as a heat generation source to ignite the smoke cakes, which meets the ignition temperature (400° C.); in addition, the silicon carbide igniters have the characteristics of rapid temperature rise, good insulation with the shell and long service life.

In the fire source system, the combustion-supporting fan is arranged at one side of the body of the fire source system and connected with the air tank through the air conduit which is horizontally or slightly obliquely arranged on the ground. The air tank uniformly distributes the air to the liquid fuel atomizing jet burners, so that the problem of overhigh jet flame of a traditional burner is solved. In addition, as each of the liquid fuel atomizing jet burners inputs air from the side, the structural length of a fire source system is shortened, so that the flame height is further reduced, ensuring that the combustion of the fire source system is controllable and the flame height is closer to a pool fire. In the meantime, the air conduit makes combustion-supporting fan keep a distance from the liquid fuel atomizing jet burners, preventing the interference of air in the liquid fuel atomizing jet burners, which ensures that air is fresh, and reduces the requirement of high temperature resistance of combustion-supporting fan. In this application, the flame produced by the liquid fuel atomizing jet burners is upward, while the intermediate level is the air tank, and the lowest level is the fuel control tank, and by supplying room temperature air to the liquid fuel atomizing jet burner to burn, while cooling the entire fire source system, it ensures that the air tank and fuel control tank are not affected by the high temperature of the flame when the entire system is burning.

According to the present disclosure, the bottoms of the first tank and the second tank are equipped with rollers, which facilitate the movement of the whole smoke generation system.

A fuel pump, a fuel filter, a pressure stabilizing tank and a rotameter are arranged in the control system in sequence. The fuel pump can provide enough flow and pressure, and the electromagnetic valves of the liquid fuel atomizing jet burners are in normally-closed mode, which can act as emergency stop. The embedded computing platform controls the rotating speed and the pressure of the fuel pump through a program according to the flow feedback of the rotameter to realize real-time and accurate control of the output flow and the pressure, which has the advantages of process stability and data reliability. The control system can at the same time give feedback of the working state, the fault alarm of the liquid fuel atomizing jet burners in real-time. Meanwhile, parameters such as smoke generation speed of the smoke generation box can be controlled according to program setting, and therefore automatic control of the hot smoke testing system is achieved.

wherein 1—fire source system, 2—smoke generation system, 3—control system, 4—remote touch screen, 101—combustion-supporting fan, 102—air conduit, 103—electrical control input plug, 104—fuel input port, 105—fuel control tank, 106—roller, 107—air tank, 108—guardrail, 109—liquid fuel atomizing jet burner, 111—rectifier wheel, 112—fuel atomizing nozzle, 113—fuel duct, 114—first flange, 115—second flange, 116—cowling, 117—upper air duct, 118—lower air duct, 121—fuel and control input interface, 122—electronic high-voltage ignition transformer, 123—thermocouple, 124—first electrical control box, 125—fuel control valve, 126—fuel distribution box, 201—smoke outlet pipe, 202—smoke cake clamp, 203—smoke cake turntable, 204—igniter, 205—smoke generation electrical control box cover, 206—smoke generation electrical control box, 207—smoke generation box, 208—smoke cake drawer, 209—smoke outlet pipe bracket, 210—electrical plug, 211—second electrical control box, 212—servo motor, 213—ventilation hole, 214—speed-regulating blower, 215—smoke cake clamp jack, 216—rotary disc, 217—smoke cake entrance, 218—position sensor, 219—top cover, 220—bottom cover, 221—second through hole, 222—first through hole, 301—fuel pump, 302—fuel filter, 303—pressure stabilizing tank, 304—rotameter, 305—integrated control box.

DETAILED DESCRIPTION OF THE INVENTION

In order to make the objects, technical solutions and advantages of the present disclosure clearer, the present disclosure is further described in detail below with reference to the accompanying drawings and embodiments. It should be understood that the specific embodiments described herein are merely for the purpose of illustrating the present disclosure and are not considered as limitation to the present disclosure.

Figure 1:
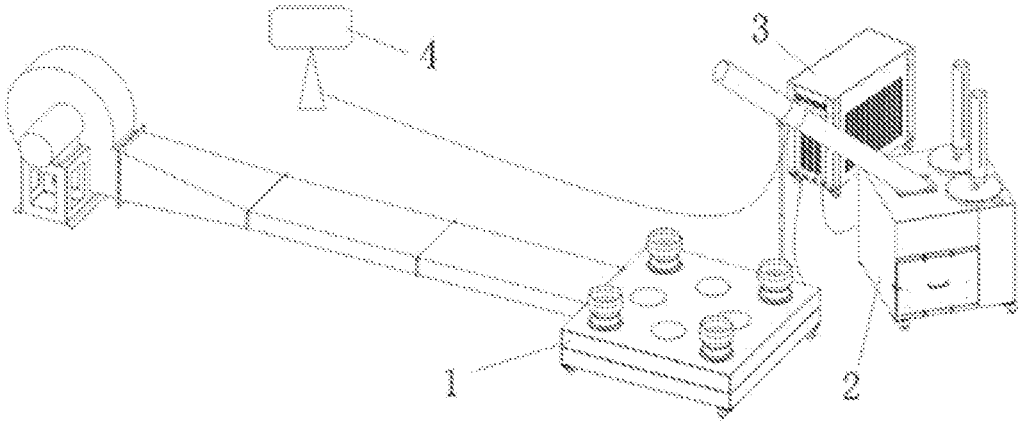
FIG. 1 is a schematic diagram of the overall configuration of an automatic control type hot smoke testing system of the present disclosure.

An automatic control type hot smoke testing system, as shown in FIG. 1, includes a fire source system 1, a smoke generation system 2 and a control system 3.

Figure 2:
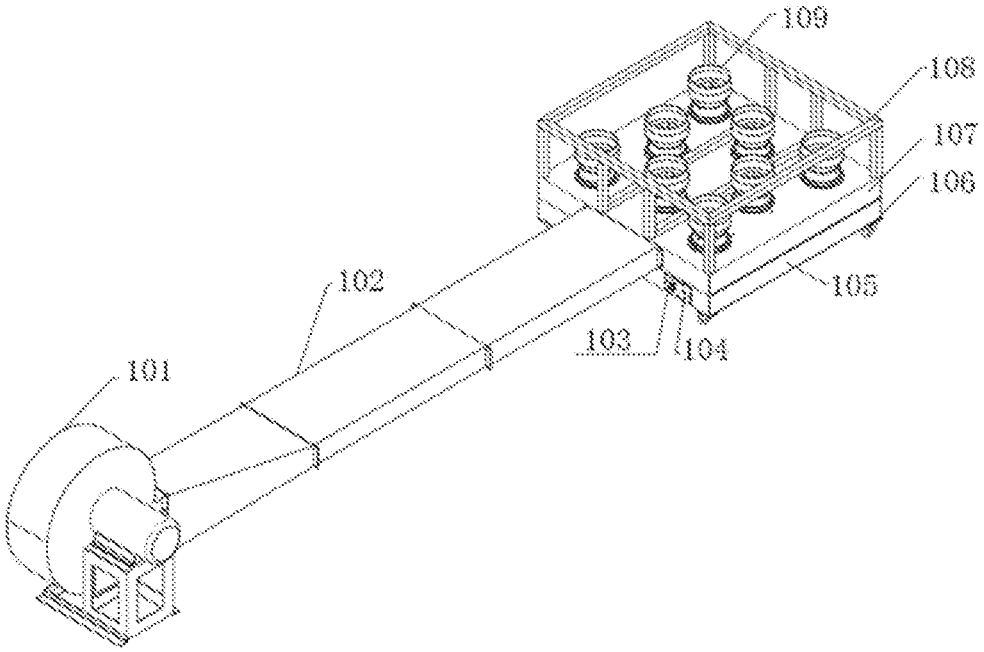
FIG. 2 is a schematic diagram of the overall configuration of the fire source system of the present disclosure.
Figure 5:
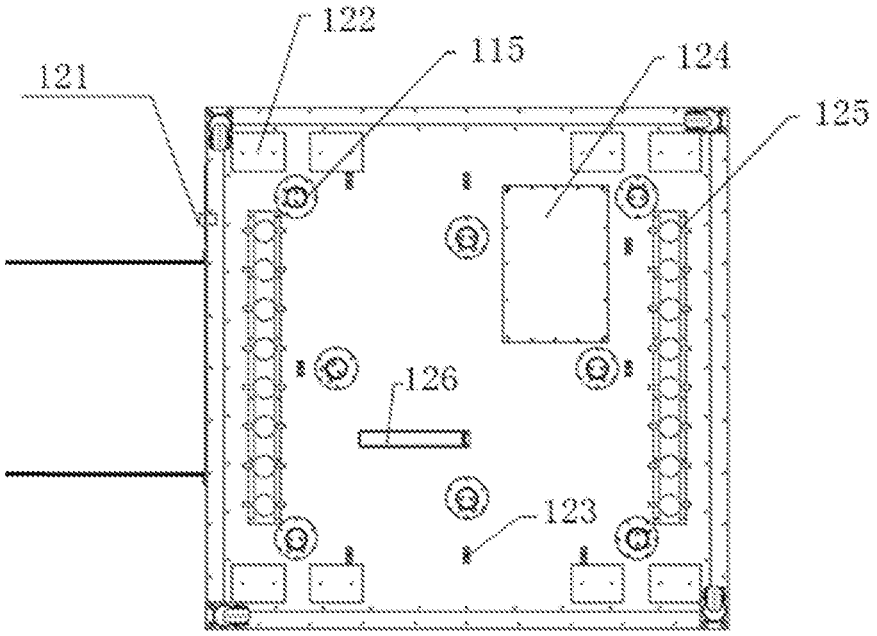
FIG. 5 is a schematic diagram of the structural layout of the fuel control box at the bottom of the fire source system of the present disclosure.

As shown in FIG. 2, the fire source system 1 includes a first tank and several liquid fuel atomizing jet burners 109 disposed above the first tank. The liquid fuel atomizing jet burners 109 are preferably methanol burners, through which methanol can be atomized and combusted, and the atomized methanol can generate a larger heat release rate than the pool fire with same quality methanol. As shown in FIG. 2 and FIG. 5, in the present embodiment, the first tank has a square cross section, including an air tank 107 and a fuel control tank 105, and the air tank 107 and the fuel control tank 105 have the same cross section, which is 1000 mm×1000 mm×400 mm, and the fuel control tank 105 is located at the bottom of the air tank 107. The air tank 107 is responsible for supplying air into the liquid fuel atomizing jet burners 109 to improve the combustion efficiency; the fuel control tank 105 is responsible for controlling valves, distributing methanol, checking flame etc. of the liquid fuel atomizing jet burners 109. The top nozzle of the liquid fuel atomizing jet burners 109 is isolated from the fuel control tank 105 by the air tank 107, resulting in high security and reduced influence of high temperature on the control system on a test site.

The air tank 107 and the fuel control tank 105 are all made of 304 stainless steels, which have good corrosion resistance and formability. In order to maintain the corrosion resistance inherent in stainless steel, 304 stainless steels must contain more than 18 wt % of chromium and more than 8 wt % of nickel. In addition, 304 stainless steel has good heat resistance, low-temperature strength and mechanical properties, good hot workability such as stamping, bending and the like, no heat treatment hardening phenomenon (using at the temperature of −196° C. to 800° C.), and meets the application requirements of the high-temperature environment of the liquid fuel atomizing jet burners.

The liquid fuel atomizing jet burners 109 may be disposed at each of four corners of the first tank, or 4 more uniformly at the center of the first tank cross section. The present application does not set any limitation to the specific number and position of the liquid fuel atomizing jet burners 109.

The bottom main body of each liquid fuel atomizing jet burner 109 extends into the first tank and an air duct and a fuel duct 213 is provided therein, respectively, and the air duct extends into the air tank 107 and is provided with an air inlet. An air inlet of the air tank 107 is connected to a combustion fan 101 through an air conduit 102 provided at one side of the first tank. As shown in FIG. 2, the air conduit 102 is horizontally or obliquely arranged on the ground, and the combustion fan 101 is also fixed on the ground by a fixing bracket, and the air conduit 102 has a variable cross-section at the end close to the combustion fan 101, and the cross-section is larger the closer to the combustion fan 101. In the present application, the combustion fan 101 is placed on one side of the body of the fire source system and is connected with the air tank 107 through the air conduit 102 which is horizontally or slightly obliquely arranged on the ground, and the air tank 107 evenly distributes the air to the liquid fuel atomizing jet burners. An existing methanol burner generally flames horizontally and cannot simulate flame of a fire scene or shape of a pool fire. When the existing methanol burner is installed vertically, an initial position of the flame is relatively high, and the length of the flame is too long, so that the methanol burner is not suitable for fire source simulation in a fire test field. The present disclosure has solved the problem that the flame jet position of the traditional methanol burner is too high. In addition, as the liquid fuel atomizing jet burners input air from the side, the structural length of a fire source system is shortened, so that the flame jet height is further reduced, ensuring that the combustion of the fire source system is controllable and the combustion height is closer to the flame height of a pool fire. In the meantime, the air conduit makes combustion fan keep a distance from the liquid fuel atomizing jet burners, preventing the interference of air in the liquid fuel atomizing jet burners, to ensure that air is fresh, and also reduce the requirement of high temperature resistance of combustion fan.

Figure 3:
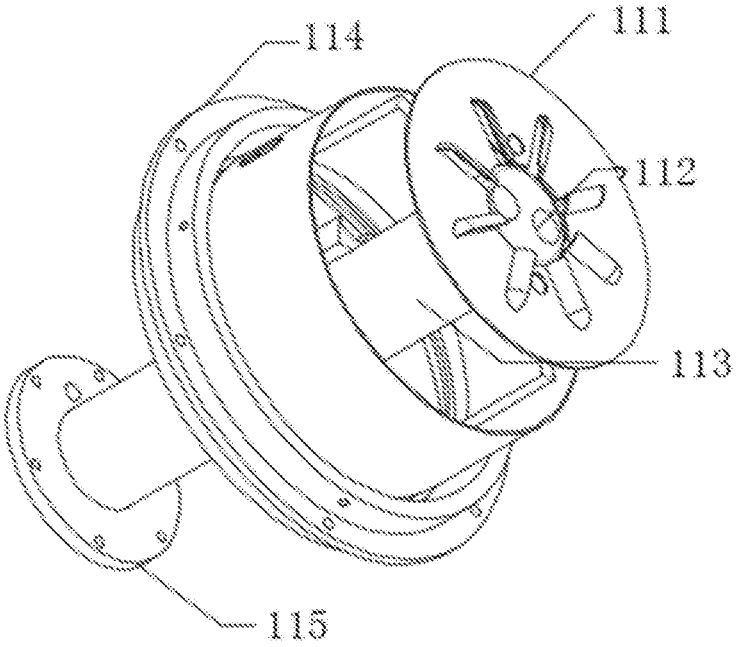
FIG. 3 is a schematic diagram of the internal configuration of a liquid fuel atomizing jet burner of the present disclosure.
Figure 4:
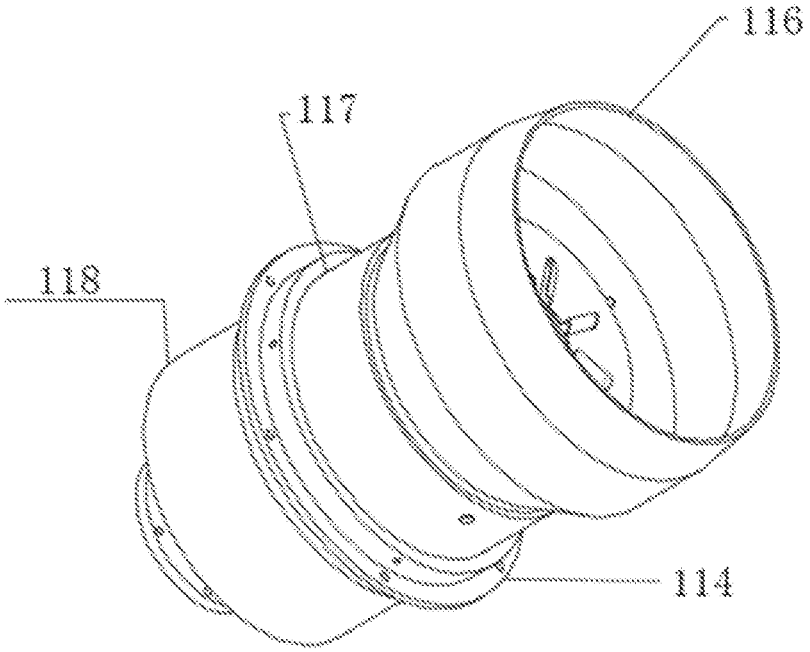
FIG. 4 is a schematic diagram of the external configuration of the liquid fuel atomizing jet burner of the present disclosure.

As shown in FIG. 3 and FIG. 4, the bottom main body of each of the liquid fuel atomizing jet burners 109 is a coaxial hollow cylinder shape, the outer ring of which is an air duct, and the fuel duct 113 is disposed inside the air duct.

The air duct is formed by connecting an upper air duct 117 and a lower air duct 118 through a first flange 114, and the air duct is fixed on the top of the air tank 107 through the first flange 114; the fuel duct 113 is fixed at the bottom of the fuel control tank 105 by a second flange 115 disposed at the bottom of the fuel duct 113. The fuel duct 113 is used to transport methanol and support the liquid fuel atomizing jet burners. An intermediate layer between the fuel duct 113 and the upstream of the air duct serves for supplying air.

The top of the fuel duct 113 is equipped with a rectifier wheel 111, and the top of the air duct is equipped with a cowling 116, wherein the rectifier wheel 111 is located inside the cowling 116. The rectifier wheel is mainly used for flame shaping, and the cowling can improve the pressure of air and define the shape of flame.

The top of the fuel duct 113 is also provided with a fuel atomizing nozzle 112 and an ignition needle.

As shown in FIG. 5, the fuel control tank 105 includes several fuel control valves 125 and a fuel distribution box 126 therein, and a fuel supply pipe disposed outside the first tank is connected to the fuel guide duct 113 through the fuel distribution box 126 and the several fuel control valves 125 in sequence. The number of the fuel control valves 125 corresponds to the number of the liquid fuel atomizing jet burners 109.

A first electrical control box 124 and several electronic high-voltage ignition transformers 122 are arranged in the fuel control tank 105, where the electronic high-voltage ignition transformers 122 are connected with the ignition needles and the number of which correspond to the number of the ignition needles and the first electrical control box 124 is used for controlling the fuel control valve 125 and the electronic high-voltage ignition transformers 122.

One side of the fuel control tank 105 is provided with a fuel and control input interface 121, which includes an electrical control input plug 103 which is connected to the first electrical control box 124. And the fuel input port 104 is an interface of the fuel supply pipe.

Several thermocouples 123 which are connected to the first electrical control box 124 and are used for measuring temperature are further arranged in the fuel control tank 105, so that the fire source system has a protection function of automatic cut-off after flameout.

At the top of the first tank, a guardrail 108 is further arranged around several liquid fuel atomizing jet burners 109 to prevent the liquid fuel atomizing jet burners 109 from external force collision.

The air tank 107 and the fuel control tank 105 are both made of 304 stainless steels, and the fuel control tank 105 is located at the bottom of the air tank 107.

The fuel control valves 125, which can function as emergency stop, are electromagnetic valves.

As shown in FIG. 5, the fuel control box is a flat integrated control system. Fuel enters from the fuel input port 104, then stabilized in pressure in the fuel distribution box 126, after that, entering the liquid fuel atomizing jet burners 109 for combustion after passing through the plurality of fuel control valves 125. The first electrical control box 124 has a good sealability by which the fuel control valves 125 and the electronic high-voltage ignition transformer 122 are controlled.

Figure 6:
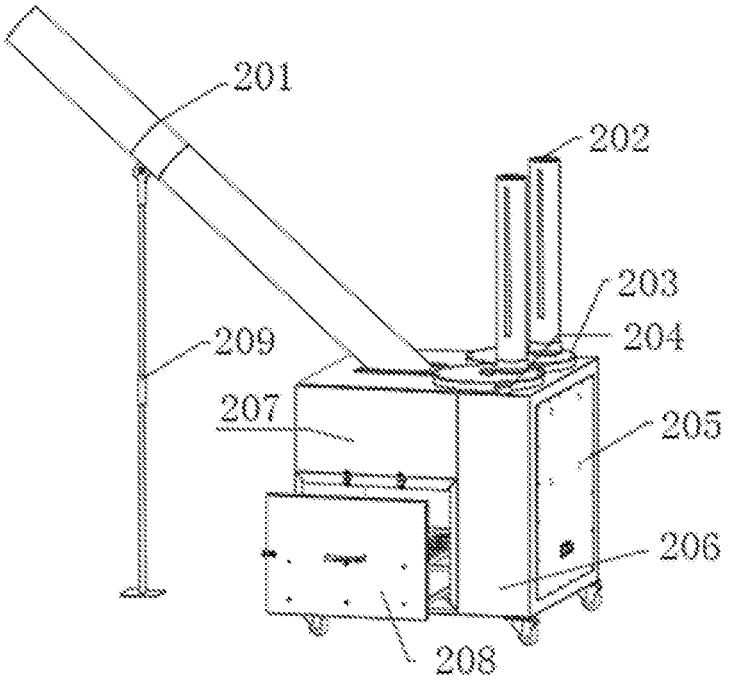
FIG. 6 is a schematic diagram of the overall configuration of the smoke generation system of the present disclosure.
Figure 7:
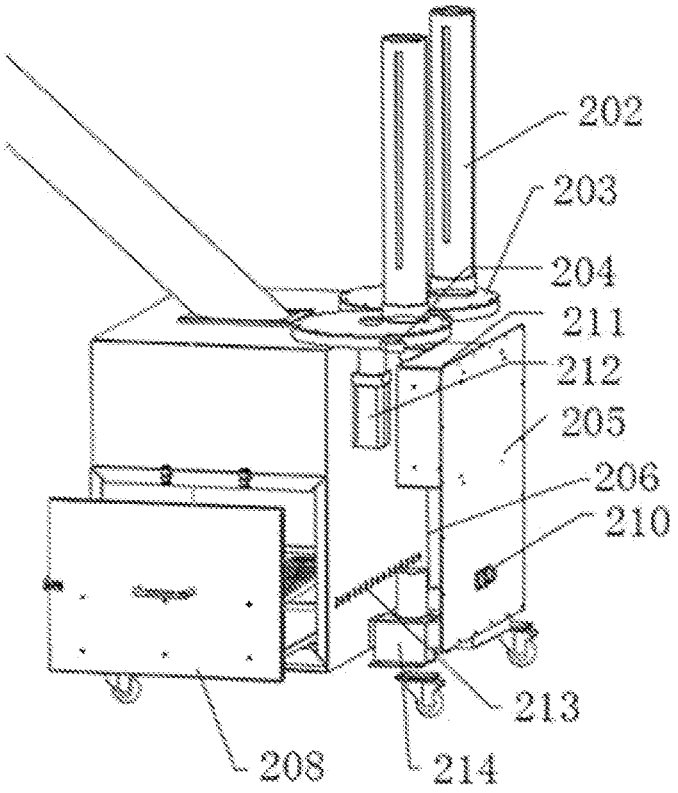
FIG. 7 is a schematic diagram of the internal configuration of the smoke generation system of the present disclosure.

As shown in FIG. 6 to FIG. 7, the smoke generation system 2 includes a second tank, a smoke outlet pipe 201, smoke cake clamps 202 and smoke cake turntables 203.

The second tank includes a smoke generation electrical control box 206 and a smoke generation box 207, which are positioned at two sides of the second tank respectively. The smoke cakes fume in the smoke generation box 207, and equipment such as a servo motor 212, a speed-regulating blower 214, a second electrical control box 211 are arranged in the smoke generation electrical control box 206, and a detachable smoke generation electrical control box cover 205 is arranged on one side of the smoke generation electrical control box, and an electrical plug 210 is further arranged on the smoke generation electrical control box cover 205, wherein the second electrical control box 211 may be connected with the control system through an RJ45 internet socket. The smoke generation electrical control box and the smoke generation box are physically isolated, so that equipment can be prevented from corroding from strong corrosive gas generated in the smoke generation process of the smoke cakes, and the service life of the instrument and equipment is prolonged.

The smoke outlet pipe 201 which is obliquely arranged on the top of the second tank is communicated with the smoke generation box 207. The smoke cakes are burned in the smoke generation box for smoke generation and the smoke is transport to the atmosphere through the smoke outlet pipe 201. The smoke outlet pipe 201 is a telescopic pipe with adjustable length and is fixed by a smoke outlet pipe bracket 209 vertically standing on the ground. The middle part of the smoke outlet pipe 201 is provided with a pipe hoop which is connected with the top of the smoke outlet pipe bracket 209 though a bolt. Referring to FIG. 6, a supporting platform is provided at the bottom of the smoke outlet pipe bracket 209, and the height of the smoke outlet pipe bracket 209 in the vertical direction can also be adjusted. Preferably, the smoke outlet pipe bracket 209 is formed by connecting two or more brackets through screw threads/a screw thread, so that the height of the smoke outlet pipe bracket can be conveniently adjusted, and meanwhile, the smoke outlet pipe bracket 209 can be conveniently detached, installed and transported.

The smoke cake clamps 202, which are vertically arranged at the outer side of the top of the second tank, are used for storing smoke cakes. Specifically, several smoke cakes are sequentially stacked in the smoke cake clamps 202 and form a vertical column. The arrangement of the smoke cake clamps can make the adding of the smoke cakes more convenient and faster. Considering that the smoke cakes may expand after being wetted and heated, the inner diameter of each of the smoke cake clamps is at least 5 mm larger than that of the smoke cake, so that the smoke cakes can drop more smoothly.

The smoke outlet pipe 201 and the smoke cake clamps 202 are detachable relative to the second tank, which would facilitate long-distance transportation and installation.

Figure 8:
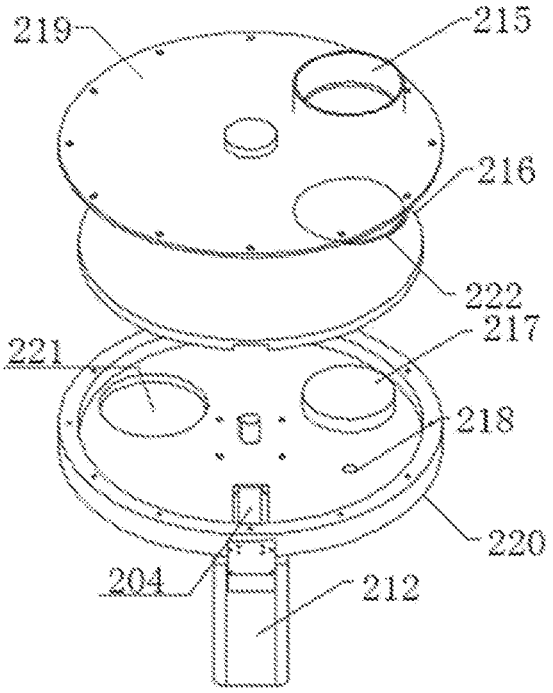
FIG. 8 is a schematic diagram of a structure of a smoke cake turntable.

The smoke cake turntables 203, which are mainly used for conveying smoke cakes, are horizontally arranged at the top of the second tank and are positioned between the smoke cake clamps 202 and the second tank. As shown in FIG. 8, each of the smoke cake turntables 203 includes a top cover 219, a bottom cover 220 and a rotary disc 216 disposed between the top cover 219 and the bottom cover 220, and an output shaft of the servo motor 212 sequentially passes through the bottom cover 220, the rotary disc 216 and the top cover 219 and drives the rotary disc 216 to rotate. The top cover 219, the rotary disc 216 and the bottom cover 220 are all circular and form a smoke cake turntable 203, which is horizontally arranged at the joint of the smoke generation electrical control box 206 and the smoke generation box 207, wherein the main body of the servo motor 212 positioned in the smoke generation electrical control box 206. The smoke cake turntables 203 are driven by the servo motor 212 to rotate, moving smoke cakes in the smoke cake clamps 202 to an ignition position one by one to be ignited, and then rotating the ignited smoke cakes into the smoke generation box 207.

Preferably, one part of each of the smoke cake turntables 203 is attached to the top of the smoke generation box, and another part is attached to the top of the smoke generation electrical control box. Each of the smoke cake clamps 202 is fixed in a smoke cake clamp jack 215 on the top cover 219 and is located right above the smoke generation electrical control box, wherein the smoke cake clamp jack 201 is a through hole on the top cover.

The rotary disc 216 and the bottom cover 220 are respectively provided with a first through hole 222 and a second through hole 221 which are matched with the size of a smoke cake, wherein the first through hole and the second through hole are in staggered arrangement, with the second through hole 221 located right above the smoke generation box 207 and the first through hole 222 not located right above the smoke generation box 207. Preferably, the first through hole 222 is located right above the smoke generation electrical control box, so that the smoke cakes can fall from the smoke cake clamp, rotate through the rotary disc, and naturally fall into the smoke generation box after being ignited.

The number of the smoke cake turntable(s) 203 is one, two or more, corresponding to the number of the smoke cake clamps 202. The plurality of smoke cake clamps storing smoke cakes at the same time may prolong smoking time and improve smoking speed. In this embodiment, the number of the smoke cake turntables and the number of the smoke cake clamps 102 are both two.

The bottom cover 220 is provided with igniters 204 which are arranged between a smoke cake entrance 217 and the second through hole 221 on the bottom cover 220. The igniters 204 use silicon carbide as heat generation source, namely, the silicon carbide igniters ignite the smoke cakes, so that the ignition temperature (400° C.) of the smoke cakes can be met; in addition, the silicon carbide has the characteristics of rapid temperature rise, good insulation with the shell and long service life.

One or more position sensors 218 are further arranged on the inner side of the bottom cover 220, so that the smoke cakes can respectively stay at least 3 positions including the smoke cake entrance 217, the igniters 204 and the second through hole 221, and the stay time and rotating speed of the rotary disk are adjustable, so that the igniting of the smoke cakes with different specifications and the placing speed of the smoke cakes are adjustable.

The number of the igniter(s) and the smoke cake turntable (s) corresponds to the number of the smoke cake clamp(s) 202, which is one, two or more. The plurality of the smoke cake clamps storing smoke cakes at the same time may prolong smoking time and improve smoking speed. In this embodiment, the number of the smoke cake turntables and the number of the smoke cake clamps 102 are both two.

The inner bottom side of the smoke generation box 207 is a smoke cake drawer 208 in which a grid plate is arranged, and the smoke cakes fall onto the grid plate. Slide rails are arranged on two sides of the smoke cake drawer 208, guide grooves which are fitted and connected with the slide rails are respectively arranged on two sides of the bottom of the smoke generation box, and the slide rails slide back and forth in the guide grooves. The bottom of the grid plate of the smoke cake drawer 208 is also provided with collecting plates, so that the smoke cake waste can be conveniently and intensively treated. The push-pull type smoke cake drawer 208 provided with the sliding rails, the guide grooves and the collecting plates improves the treatment efficiency of waste materials.

The speed-regulating blower 214 is arranged at the bottom of the smoke generation electrical control box 206, and ventilation holes 213 are provided on a wall connecting the smoke generation electrical control box 206 and the smoke generation box 207, the position of which corresponds to the positions of the speed-regulating blower 214 and the grid plate. The number of the ventilation hole 213 may be one, and the size of the ventilation hole 213 corresponds to that of the outlet of the speed-regulating blower 214 when the number of the ventilation hole is one, with a check valve for preventing the reverse flow of the smoke installed at the ventilation hole. Otherwise, a row of ventilation holes may be provided horizontally at a position corresponding to the grid plate, as shown in FIG. 7. The arrangement of the ventilation holes in the bottom of the connecting wall and corresponding to the horizontal positions where the smoke cakes fall into the smoke generation box makes air enters below the smoke cake drawer through the uniformly distributed ventilation holes, to ensure the full and uniform smoke generation of the smoke cakes. The speed-regulating blower 214 in the smoke generation electrical control box 206 blows air to the smoke generation electrical control box 206 and air enters the smoke generation box through the ventilation holes 213. The air gets into below the smoke cake drawer in the smoke generation box through the uniformly distributed ventilation holes to ensure the effective smoke generation of the smoke cakes, and the smoke emits from the top of the smoke outlet pipe 201 because of wind pressure and up flow of the smoke. The speed-regulating blower can not only drive the smoke generation of smoke cakes, but also can control the emitting speed of the smoke.

The rotary disc 216 is made of solid material, and except for the first through hole for conveying the smoke cakes, apertures between the rotary disc 216 and the top cover 219 and the bottom cover 220 are both relatively small, so as to ensure that the amount of smoke emitted from smoke cakes dropping holes (i.e. the second through hole 207) of the smoke generation box 207 is very small, thereby leading the smoke to be emitted from the smoke outlet pipe 201 concentratedly.

The smoke outlet of the smoke outlet pipe 201 is located right above the liquid fuel atomizing jet burners 109 of the fire source system.

The control system 3 is connected with the smoke generation electrical control box 206 and the fuel control tank 105 respectively, in which an embedded computing platform is arranged, and an external touch screen is set for Human Computer Interaction to control the whole hot smoke testing system.

The bottoms of the first tank and the second tank are equipped with rollers, which facilitates the movement of the hot smoke testing system.

Figure 9:
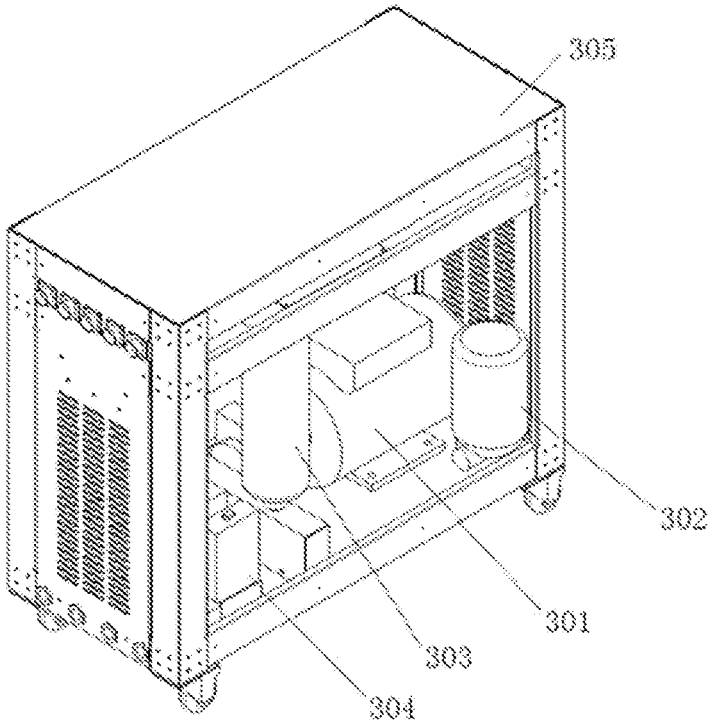
FIG. 9 is a schematic diagram of the internal configuration of the control system of the present disclosure.

As shown in FIG. 9, an integrated control box 305 is provided in the control system, which is connected to the smoke generation electrical control box 206 and the fuel control tank 105 respectively.

A fuel pump 301, a fuel filter 302, a pressure stabilizing tank 303 and a rotameter 304 are arranged in the control system in sequence. The fuel pump 301 can provide enough flow and pressure, and the electromagnetic valves of the liquid fuel atomizing jet burners are in normally-closed mode to function as emergency stop. The embedded computing platform controls the rotating speed and the pressure of the fuel pump 301 through a program according to the flow feedback of the rotameter 304, so that the output flow and the pressure may be controlled in real-time and accurately and the control system has the advantages of process stability and data reliability. The control system can at the same time give feedback of the working state, the fault alarm and the like of the liquid fuel atomizing jet burners in real-time. Meanwhile, parameters such as the smoke generation speed of the smoke generation box can be controlled according to program setting.

A digital rotameter which has the advantages of corrosion resistance, high precision and sensitive reaction is chosen. Due to the standard interface and mature technology, the digital rotameter can carried out the third-party measurement conveniently. It works by flowing methanol through the sensor, then methanol forcing the impeller to rotate, and the rotating speed of the impeller is in direct proportion to the average flow speed of the pipeline. The methanol supply is adjusted through a digital rotameter, so that the fire source power of the liquid fuel atomizing jet burners is controlled, and the accuracy and controllability of each parameter and index of the on-site hot smoke testing equipment for disaster prevention and safety of urban rail transit are ensured.

The touch screen includes a touch screen coming with a host panel of the control system and a remote touch screen 4 connected with the control system, which are both provided with emergency stop buttons, so that the power supply of the fuel pump and the liquid fuel atomizing jet burners can be cut off at any time. That is, the fuel supply can be cut off at any time to ensure high safety protection degree.

Following steps are included when using the hot smoke testing system:

1. System self-check (1) connecting hardware components of the system;

(2) connecting network cables and power supply cables;

(3) starting the speed-regulating blower and checking whether the rotation direction of the speed-regulating blower is correct;

(4) starting a software system, and checking whether the communication statuses of the fire source system, the smoke generation system and the control system are correct;

(5) checking whether the data of a fuel tank is correct;

(6) filling fuel;

(7) starting an "igniter check" in the software system, and observing whether the 8 ignition needles of the liquid fuel atomizing jet burners work right;

(8) starting a "fan", "igniting" and "starting smoke generation" of the smoke generation box and checking whether each part works right;

(9) adjusting the frequency of the speed-regulating blower to 35 HZ, and starting to operate; and

(10) setting the test mode to be a manual mode and the power to be 300 KW, then starting the test, emptying air in the pipe and meanwhile checking the flow and whether the fuel pump works right. Stop the test when the liquid fuel atomizing jet burners output flame to extinguish the flame.

2. Preparation of the test (1) adjusting the frequency of the speed-regulating blower to 35 HZ, and starting to operate;

(2) setting a thermal power output curve of the fire source system;

(3) installing the smoke cakes, and inputting the number of the smoke cakes on the software (used for displaying on software), wherein the smoke cakes in the smoke cake clamps are intact smoke cakes;

(4) checking the sealing condition of the smoke cake drawer;

(5) checking whether safety protection facilities are in place;

(6) checking whether the video recording equipment is ready;

(7) checking whether other equipment is ready; and (8) checking the residual fuel amount of the fire source system.

3. Test operation (1) starting the "igniter" of the smoke generation box, and preheating for 30 seconds;

(2) starting the fan of the smoke generation box;

(3) starting "beginning generate smoke" of the smoke generation box;

(4) waiting for 20 seconds to generate smoke (the power of the first idle time of 20 seconds can also be zero when setting the curve);

(5) starting "starting a test" of a fire source system; and (6) observing the working state of the liquid fuel atomizing jet burners, and cutting off the power supply to stop fuel output in emergency.

4. End of the test (1) stopping various works of the smoke generation box;

(2) stopping heat output of the liquid fuel atomizing jet burners and "stop the test";

(3) checking the remaining amount of fuel for proper disposal; and (4) disassembling the components and packing.

The hot smoke testing system in the present application is applied to the on-site hot smoke testing for disaster prevention and safety of urban rail transit, and particularly, the hot smoke testing system is arranged in a platform, a station hall or a tunnel of a subway station to automatically generate high-temperature hot smoke with set power and simulate real fire smoke in the subway station; and a data collection system is arranged in a platform, a station hall and a tunnel of the subway station and is used for collecting temperature, air speed, air concentration, image, thermal image, smoke height and linkage time signal of each disaster prevention system of the subway station. The system also includes a data analysis system which is connected with the data collection system through a signal transmission system and used for analyzing and processing the collected data signals. For the subway station with a complex structure and a large span, a signal transmission system for remotely transmitting the collected data signals and the operation instruction signals is also arranged.

The data collection system includes a distributed networking digital temperature measuring device for measuring the temperature field of the whole tested subway station, a high-temperature radiation temperature measuring device for measuring the temperature near a fire source and a flow measuring device for measuring the wind speed at critical section opening parts in the subway station, such as the opening part of a staircase and an escalator of a building.

Therefore, the hot smoke testing can simulate the linkage condition of each disaster prevention system of the subway station for detecting real subway fire smoke, and can also estimate performance of the disaster prevention of the subway station disaster prevention system by collecting and analyzing the relevant data of the temperature field and the flow field of the subway station in the simulation process, thereby ensuring that the requirement of safe evacuation of passengers is met in emergency.

The above is only a preferred embodiment of the present disclosure and is not intended to limit the present disclosure, and various modifications and changes may be made by those skilled in the art. Any modification, equivalent replacement, or improvement made within the spirit and principle of the present disclosure shall be included in the protection scope of the present disclosure.

What is claimed is:

1. An automatic control type hot smoke testing system, comprising:

a fire source system which comprises a first tank and several liquid fuel atomizing jet burners disposed above the first tank, wherein the first tank comprises an air tank and a fuel control tank, and a bottom main body of each of the liquid fuel atomizing jet burners extends into inside of the first tank and provides an air duct and a fuel duct, and the air duct extends into the air tank and is equipped with an air inlet; the fuel control tank comprises several fuel control valves and a fuel distribution box, and a fuel supply pipe disposed outside the first tank is connected with the fuel duct through the fuel distribution box and the several fuel control valves in sequence;

a smoke generation system which comprises a second tank, a smoke outlet pipe, smoke cake clamps and smoke cake turntables, wherein the second tank comprises a smoke generation electrical control box and a smoke generation box which are positioned at two sides of the second tank respectively, the smoke outlet pipe which is arranged at the top of the smoke generation box is communicated with the smoke generation box, the smoke cake clamps which are vertically arranged at the outer side of the top of the second tank are used for storing smoke cakes, the smoke cake turntables are horizontally arranged at the top of the second tank and are positioned between the smoke cake clamps and the second tank; the smoke cake turntables are driven by a servo motor to rotate, moving smoke cakes in the smoke cake clamps to an ignition position one by one to be ignited, and then rotating the ignited smoke cakes into the smoke generation box, and a smoke outlet of the smoke outlet pipe is positioned right above the fire source system; and a control system which is connected with the smoke generation electrical control box and the fuel control tank respectively, in which an embedded computing platform is arranged, and an external touch screen is set for Human Computer Interaction to control the hot smoke testing system.

2. The automatic control type hot smoke testing system according to claim 1, wherein the bottom main body of each of the liquid fuel atomizing jet burners is a coaxial hollow cylinder, an outer ring of which is the air duct, and the fuel duct is disposed in the air duct.

3. The automatic control type hot smoke testing system according to claim 1, wherein the air duct is formed by connecting an upper air duct and a lower air duct by a first flange, and fixed on the top of the air tank by the first flange; the fuel duct is fixed at the bottom of the fuel control tank by a second flange disposed at the bottom of the fuel duct.

4. The automatic control type hot smoke testing system according to claim 1, wherein the air inlet of the air tank is connected with a combustion fan through the air conduit provided at one side of the first tank.

5. The automatic control type hot smoke testing system according to claim 1, wherein the top of the fuel duct is equipped with a rectifier wheel, and the top of the air duct is equipped with a cowling, wherein the rectifier wheel is located inside the cowling.

6. The automatic control type hot smoke testing system according to claim 1, wherein the top of the fuel duct is further provided with a fuel atomizing nozzle and an ignition needle.

7. The automatic control type hot smoke testing system according to claim 6, wherein a first electrical control box and several electronic high-voltage ignition transformers are further arranged in the fuel control tank, wherein the electronic high-voltage ignition transformers are connected with the ignition needles and the first electrical control box is used for controlling the fuel control valves and the electronic high-voltage ignition transformers.

8. The automatic control type hot smoke testing system according to claim 7, wherein thermocouples are arranged in the fuel control tank and connected to the first electrical control box.

9. The automatic control type hot smoke testing system according to claim 1, wherein a guardrail is further arranged around the several liquid fuel atomizing jet burners at the top of the first tank.

10. The automatic control type hot smoke testing system according to claim 1, wherein the air tank and fuel control tank are both made of 304 stainless steel, and the fuel control tank is located at the bottom of the air tank.

11. The automatic control type hot smoke testing system according to claim 1, wherein the fuel control valves are electromagnetic valves.

12. The automatic control type hot smoke testing system according to claim 1, wherein each of the smoke cake turntables comprises a top cover, a bottom cover and a rotary disc arranged between the top cover and the bottom cover, and an output shaft of the servo motor sequentially passes through the bottom cover, the rotary disc and the top cover and drives the rotary disc to rotate; each of the smoke cake clamps is fixed in a smoke cake clamp jack on the top cover, and a first through hole and a second through hole which are matched with the size of a smoke cake are respectively arranged on the rotary disc and the bottom cover, wherein the first through hole and the second through hole are in a staggered arrangement, with the second through hole located right above the smoke generation box.

13. The automatic control type hot smoke testing system according to claim 1, wherein the smoke outlet pipe is a telescopic pipe with adjustable length and fixed by a smoke outlet pipe bracket vertically standing on the ground.

14. The automatic control type hot smoke testing system according to claim 13, wherein a middle part of the smoke outlet pipe is provided with a pipe hoop which is connected with the top of the smoke outlet pipe bracket though a bolt, and the height of the smoke outlet pipe bracket in the vertical direction is adjustable.

15. The automatic control type hot smoke testing system according to claim 1, wherein an inner bottom side of the smoke generation box is a smoke cake drawer, in which a grid plate is arranged, and the smoke cakes fall onto the grid plate.

16. The automatic control type hot smoke testing system according to claim 15, wherein a speed-regulating blower is arranged at the bottom of the smoke generation electrical control box, and ventilation holes are provided on a wall connecting the smoke generation electrical control box and the smoke generation box, the positions of ventilation holes correspond to the positions of the speed-regulating blower and the grid plate.

17. The automatic control type hot smoke testing system according to claim 12, wherein the bottom cover is provided with igniters which are arranged inside the edge of the smoke cake turntables.

18. The automatic control type hot smoke testing system according to claim 17, wherein the igniters use silicon carbide as a heat generation source.

19. The automatic control type hot smoke testing system according to claim 12, wherein position sensors are arranged on the inner side of the bottom cover.

20. The automatic control type hot smoke testing system according to claim 1, wherein the number of the smoke cake turntables corresponds to the number of smoke cake clamps.

21. The automatic control type hot smoke testing system according to claim 1, wherein the bottom of the first tank and the second tank are both equipped with rollers.

22. The automatic control type hot smoke testing system according to claim 1, wherein an integrated control box is provided in the control system and connected to the generation electrical control box and the fuel control tank, respectively.

23. The automatic control type hot smoke testing system according to claim 22, wherein a fuel pump, a fuel filter, a pressure stabilizing tank and a rotameter are further arranged in the control system; the integrated control box controls the fuel flow by controlling the rotating speed and the pressure of the fuel pump; a measurement of the fuel flow is transmitted back to the integrated control box by the rotameter.

24. The automatic control type hot smoke testing system according to claim 1, wherein the touch screen comprises a touch screen coming with a host panel and a remote touch screen connected with the control system, which are both provided with emergency stop buttons.

* * * * *